US005567075A

United States Patent [19]

Allen

[11] Patent Number: 5,567,075

[45] Date of Patent: Oct. 22, 1996

[54] OFFSET SCREED SYSTEM AND QUICK CONNECT MOUNTING THEREFORE

[75] Inventor: J. DeWayne Allen, Paragould, Ark.

[73] Assignee: Allen Engineering, Inc., Paragould, Ark.

[21] Appl. No.: 499,559

[22] Filed: Jul. 7, 1995

[51] Int. Cl.[6] ..... E01C 19/00

[52] U.S. Cl. ..... 404/84.5; 404/102; 404/118

[58] Field of Search ..... 404/84.05, 84.1, 404/84.5, 96, 101, 102, 118, 119, 114, 115, 85

[56] References Cited

U.S. PATENT DOCUMENTS

| | | | |
|---|---|---|---|
| 5,129,803 | 7/1992 | Nomura et al. | 404/102 X |
| 5,288,166 | 2/1994 | Allen et al. | 404/84.5 X |
| 5,328,295 | 7/1994 | Allen | 404/84.1 |
| 5,352,063 | 10/1994 | Allen et al. | 404/102 X |

*Primary Examiner*—Tamara L. Graysay
*Assistant Examiner*—James A. Lisehora
*Attorney, Agent, or Firm*—Stephen D. Carver; Trent C. Keisling

[57] ABSTRACT

A laser controlled automatic grade control system for finishing plastic concrete mounts the finishing tool behind the support towers to resist furrowing. The system functions with a variety of elongated, multi-section concrete finishing tools such as triangular truss screeds or the like, all of which can be quick connected or disconnected from the tower system. Skis that support the device facilitate sliding, winch-driven movement over and through plastic concrete. Spaced apart, vertically upwardly extending towers support the device along the length of the finishing tool. The towers are cylinder-adjustable in length. Cylinder extension and retraction are governed by a sensor-controlled system that is laser operated. The sensors respond to a preestablished laser beacon to control finishing tool elevation as the device traverses the pour in response to its winches.

10 Claims, 7 Drawing Sheets

OFFSET SCREED SYSTEM AND QUICK CONNECT MOUNTING THEREFORE

BACKGROUND OF THE INVENTION

1. Field of the Invention

This invention relates generally to laser-guided automatic grade control (i.e., AGC) concrete finishing devices that smoothly and continuously finish large concrete surfaces to a substantially uniform grade and finish. More particularly, this invention relates to laser-operated, automatic grade controlling devices for concrete finishing of the type classified in U.S. Class 404, subclasses 84, 114, 118 and/or 120.

2. The Prior Art

As recognized by those skilled in the concrete finishing arts, after concrete is initially placed during construction, it must be appropriately finished to give it a smooth, flat, homogeneous and correctly textured surface and appearance. Numerous finishing devices, including screeds, have long been in use throughout the industry for treating plastic concrete. Known prior art systems include "bull" floats, various forms of finishing boards, strike-offs, pans, plows, blades and the like. Bull floats essentially comprise a flat wooden board attached to a handle, much like a broom handle. These floats are manipulated by a single worker. Strike-offs contact rough, unfinished plastic concrete with a rigid leading edge to initially form, level and grade.

It is well known that either external or internal vibration facilitates concrete settling and finishing, and many vibrating systems have previously been proposed. In general, vibration promotes the attainment of a smooth, uniform product. Vibration during strike-off and subsequent screeding helps to settle the concrete and eliminate entrapped air voids. Vibration helps to densify and compact the concrete. Vibrational screeding also draws out excess water thereby increasing the structural integrity of the placed concrete. A fine layer of component cement and sand aggregate is raised to the surface by vibration along with the excess water. This cementitious slurry aids subsequent fine finishing. Often screeds extend between and rest upon the forms between which the plastic concrete is actually confined. Forms constrain the concrete until it is set, and they often provide a working structural support for the typical screed or finishing machine.

The selection of strike-off design and vibration technique for a particular machine is based upon a variety of factors, such as the characteristics of the concrete. Variables relating to concrete finishing result from the selected type and percentage of aggregate, sand, cement, admixtures, and water. Temperature, slab thickness, slump and placement method also vary the application procedure. Those skilled in the art will recognize that the selected finishing equipment must be appropriately mated to the job demands.

Thus in screeding, for example, an optimum strike-off design and vibration technique must be chosen based on the condition of the concrete and the desired results. If high slump concrete is to be screeded, a floating pan would be ideal. For finishing relatively dryer concrete, a heavier twin-bladed screed or strike-off might be more desirable. In all cases it is desirable to insure the development of a proper grade. In other words, the plane of the installed concrete surface must be properly aligned and oriented.

I previously have been involved with several patents in the art of concrete placement and finishing. Typical is a prior art self-propelled "triangular truss" screed that rides upon forms seen in U.S. Pat. No. 4,349,328. Additionally, U.S. Pat. No. 4,798,494 discloses a floating vibratory screed intended to facilitate the finishing of concrete with or without forms. U.S. Pat. Nos. 4,316,715, 4,363,618 and 4,375,351 are also relevant to the general technology discussed herein. All the above patents have been assigned to the same assignee as the present case.

U.S. Pat. No. 5,288,166, issued Feb. 22, 1994 and owned by the same assignee as in this case, discloses an automatic grading control screed having a transverse finishing mechanism transported by skiis. Vertical supporting towers support the skiis at periodic intervals. Each tower comprises a pair of stanchions disposed on opposite sides of the finishing tool. Suitable control cylinders raise and lower the stanchions to elevate or lower the tool and control finishing level. The cylinders are controlled by a beacon laser.

U.S. Pat. No. 5,328,295 issued Jul. 12, 1994 is also owned by the same assignee as in this case. The finishing tool is controlled by towers comprising a pair of extensible, spaced apart stanchions hinged to the skis and disposed on opposite sides of the tool. Suitable cylinders associated with each tower control elevation. The orientation of the finishing tool is torsionally controlled to achieve a smooth finish. Laser sensors detect a preestablished laser beacon for automatic level control.

U. S. Pat. Nos. 4,650,366 and 4,386,901 disclose screeds capable of formless, self-supporting or floating operation. The latter reference discloses a relatively heavy triangular truss screed adapted to be operated by two workmen without the use of forms. U.S. Pat. No. 4,650,366 discloses a light weight, portable vibrating screed including a central, extruded beam element.

Another prior art floating screed of general relevance is disclosed in a video tape produced by the American Concrete Institute and The Portland Cement Association, entitled "Finishing Concrete Flatwork," that bears a Copyright date of 1984. Other prior art screeds, generally of the "form-riding" type, include those screeds disclosed in U. S. Pat. Nos. 4 4,340,351; 4,105,355; 2,651,980; 2,542,979; 3,095,789; 2,693,136; and 4,030,873.

Lasers are commonplace on the modern construction site.

They are employed in surveying, earthwork and general layout operations. Fukukawa U.S. Pat. Nos. 4,861,189 and 4,854,769 disclose a system for paving inclined and/or curved surfaces. This system employs anchor vehicles and paving vehicles. The paving vehicles are secured to the anchor vehicles by wires. The connections of the wires to the anchor vehicles are controlled by a laser sensing device. Microcomputers control the shape of the paving devices to create compound and complex curves in paved surfaces.

Two devices employing a vehicle with a boom terminating in a screed are disclosed in Hansen U.S. Pat. No. 5,039,249 and Quenzi U.S. Pat. No. 4,930,935. Each of these patents relates to an anchor vehicle and a telescoping boom extending horizontally from the vehicle. The boom terminates in a screeding device that may also employ augers and vibrators. A second Quenzi patent number 4,978,246 discloses an apparatus and method for controlling laser guided machines. This patent relates to an improvement to the above Quenzi patent.

Owens U.S. Pat. No. 4,752,156 discloses a manually operated laser guided portable screed having a pair of laser sensors. Operators manually adjust the height of the screed as they draw it across placed concrete in response to a signal from the laser sensor. The above mentioned devices use a stationary laser beacon that projects laser light in a 360 degree plane.

However, all prior art devices known to me fail to yield an absolutely flat concrete surface. In particular, tower elevated ski type laser screeds often leave a minor furrow in the plastic concrete behind the trailing tower stanchion. Conventionally, a screed system having its tower supports on opposite sides of the finishing blade or mechanism does not finish or pan that portion of the concrete surface immediately to the rear. Hence, I have developed an automatic grade control screed that diminishes furrowing and increases smoothness. At the same time, the screed must resist oscillation, must offer torsional correction, and must concurrently vary elevation as well as known laser screeds. Furthermore, it is desirous that each active side of the tower be mechanically isolated from the another so that minor torsional corrections in screed orientation do not result in oscillations.

SUMMARY OF THE INVENTION

My new automatic grade control screed employs an elevation-controlling laser-operated tower system that mounts to a variety of concrete finishing tools disposed in an offset configuration. The device precisely levels concrete areas with a selected finishing tool, such as a screed or the like, and at the same time annoying furrowing is avoided. Inherent tool balance is achieved through the structure orientation to be described.

Several frame elements of the selected finishing tool can be ganged together to form the desired length. The combined finishing tool extends transversely between and behind elevation control towers disposed upon flexible skis supported below the surface of the plastic concrete. The spaced apart control towers are balanced to dynamically support the finishing tool that trails the towers along the surface of the plastic concrete.

As in my prior patents, a laser beacon is established at a fixed elevation or angle of inclination. The towers are adjusted to initially obtain the desired tool elevation, and the proper hydraulic cylinder displacement. The sensors on the masts are adjusted to obtain initial alignment of the laser and sensors. As the device moves over the plastic surface, tower stanchions are extended or retracted to maintain the screed at the proper elevation. Displacement by extension or retraction of the towers is localized due to defection of the skis at their flexible connections and at the pins securing the skis to the stanchions.

Means are provided for quick connecting the trailing finishing mechanism to the tower supports. The connecting apparatus vibrationally isolates the towers from the finishing mechanism, so vibrations transmitted along the mechanism length intended for transmission to the plastic concrete do not interfere with automatic elevation adjustments to the stanchion towers. In other words, oscillations and interference are prevented.

Further, the quick connect mechanism provides gross mechanical adjustments to mechanism elevation, so that it may be quickly adjusted for example, for subgrading. Finally, the apparatus is dynamically-balanced so that moments from the offset weight of the finishing mechanism are balanced by equal and opposite translated forces to preserve the dynamic integrity of the offset configuration.

Thus a fundamental object of my invention is provide an automatic grade control laser screed that more precisely and uniformly finishes concrete surfaces than prior art devices.

Another fundamental object of my improved screed is to avoid surface furrowing in laser screeds that have hitherto been caused by tower sections that trail the finishing mechanism.

Another important object is to provide an automatic grade control screed ski system of the character described that can be selectively attached to a variety of finishing tools including the well known triangular truss screed, bull floats, finishing pans, strike offs, roller tube finishers, plows, pavers with shaped blades and the like to facilitate the placing and finishing of plastic concrete.

Another important object is to provide an improved laser-controlled, automatic grade control (i.e., AGC) screed for concrete placing and finishing that provides the smoothest possible finish in the shortest possible time.

Another important object is to provide an offset AGC screed of the character described that gradually and smoothly effectuates grade control without jerking and rocking.

Still another object is to provide an offset AGC screed of the character described that mounts an offset finishing screed or tool, while inherently preserving balance.

A still further object is to place concrete slabs on grades and extremely large areas without forms.

A related object is minimize the weight borne by forms when and if forms are used.

A more particular object of the present invention is to provide a portable laser controlled grade fixing device and method for automated use of a self-floating vibrating screed for striking-off, float finishing, and vibrating plastic concrete without forms in a single pass, and without furrowing.

A related object is to provide a leveling system of the character described that can be quickly connected to or disconnected from vibrating screeds comprising rotating shaft eccentrics, electric vibrators, pneumatic vibrators or other vibration techniques.

Another fundamental object of the present invention is to provide grade fixing device of the character described that can mount screeds of various configurations.

Yet another object of the present invention is to ease the use screeds (or other concrete finishing tools) with relatively high slump or low slump concrete.

Another object is to finish large square footages of plastic concrete with a minimum of personnel, and with minimal repetitive operations.

A still further object is to provide a screed of the character described capable of easily negotiating a column line. It is a feature of the present invention that the preferred screed finishing tool may either be manually positioned to dodge obstacles, or its ends may be folded out of the way of columns, plumbing, and other obstacles.

Another important object is to provide a screed of the character described that preserves surface variations to $\pm 1/16$ of an inch over approximately 1000 feet of slab.

Yet another object is to provide an AGC laser screed system of the character described that accurately establishes enhanced floor flatness levels (i e., "ff" of approximately 50 or better). The present screed can finish a large slab to a flatness level of $\pm 1/8$ inch in 10 feet stretches.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible:

Figure 1, with portions omitted for clarity;

DETAILED DESCRIPTION

Figure 1:
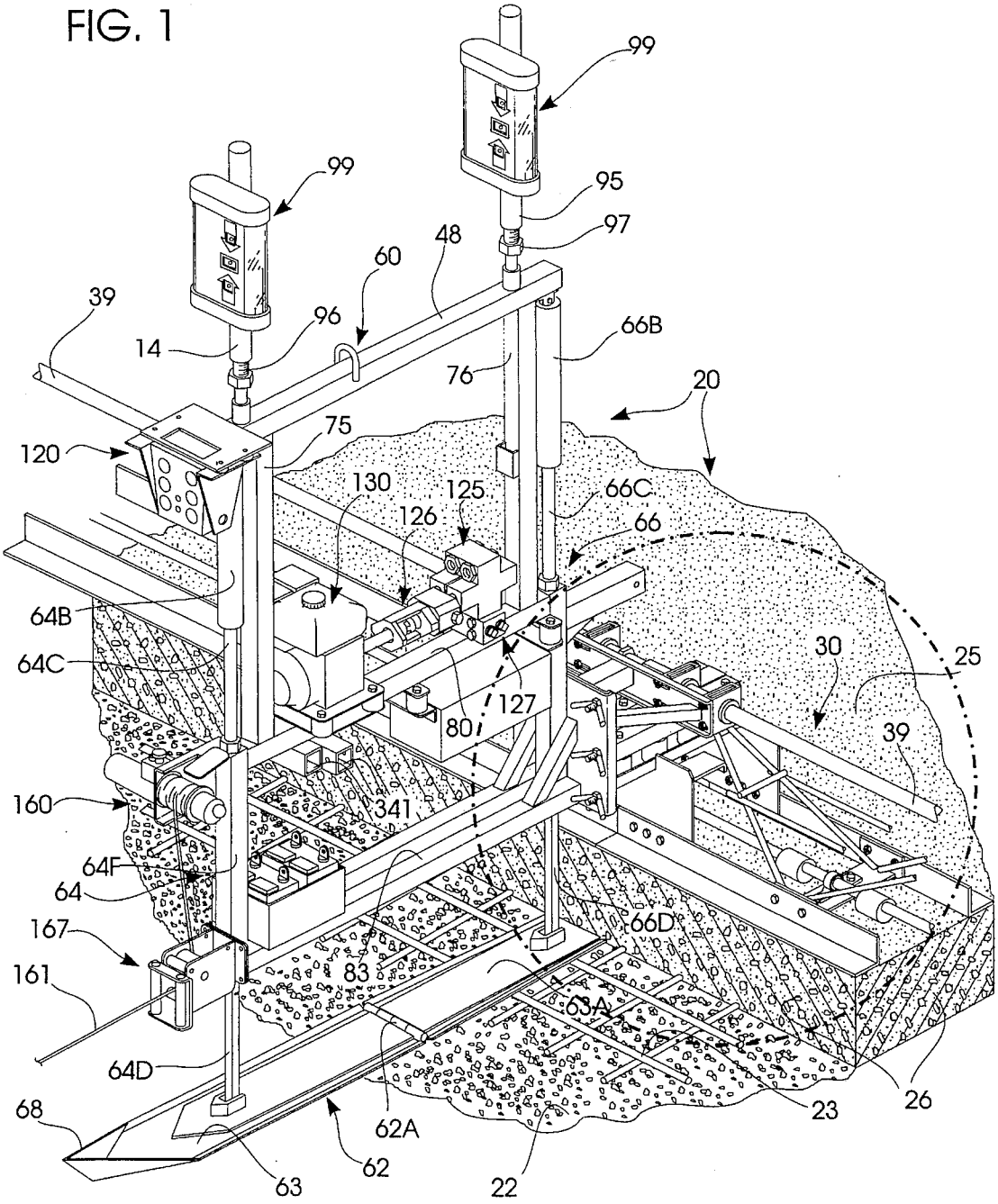
FIG 1. is a fragmentary isometric view of my Offset Screed System and Quick Connect Mounting Therefore shown in actual use.

In the drawings, the preferred embodiment of my Offset Screed System and Quick Connect Mounting Therefore is broadly designated by the reference numeral 20. Screed system 20 finishes concrete surfaces 25 by passing an elongated concrete finishing mechanism such as a vibratory screed 30 over freshly placed, plastic concrete slab 26. The elongated concrete finishing mechanism 30 is operationally suspended between and behind two or more spaced apart ski-tower assemblies 60. The tower skiis ride on the sub-grade 22 or preinstalled rebar 23, skidding along through the plastic slab 26 towards the left (as viewed in FIG. 1 ) . The tower assemblies 60 are pivotally pinned at each side to hinged skis 62 for skidding movement. The towers 60 dynamically control the elevation of the finishing mechanism 30 that extends between and behind them. As the system is drawn through plastic concrete by cables 61, it establishes desired grade with little variation.

Laser sensing is employed for grade determination and control. Aspects of the laser configuration and the tower ski arrangement are explained in detail in my prior U.S. Pat. Nos. 5,288,166, issued Feb. 22, 1994, and 5,328,295 issued Jul. 12, 1994 which are hereby incorporated by reference. As in the aforementioned references, the selected finishing tool is controlled by the extensible and retractable towers. The towers comprise a pair of extensible, spaced apart stanchions hinged to the skis operated by suitable cylinders in turn controlled by the laser system.

As illustrated, finishing device 30 comprises a vibrating triangular truss screed. However, the ski tower assemblies 60 can be mounted to a bull float, a pan, a strike-off, of other bladed finishing device. As will be recognized by those skilled in the art, such finishing mechanisms are assembled from several sections at the job site to provide the desired length. It is preferred that multiple towers 60 be employed in conjunction with the grading system. The number of joined sections depends upon the application length and the available clearance.

The illustrated triangular truss screed 30 has an integral elongated, triangular-truss frame 40. Frame 40 comprises a leading strike-off 41 spaced apart from a similarly-profiled float 42, both of which have a generally L-shaped cross section. Spaced apart cross-braces 44 extend between members 41, 42 to secure the screed. Strike-off 41 and float 42 form the base of the finishing mechanism. The apex of the triangular cross section is established by a rigid, cylindrical shaft 39, joined at regular intervals to the lower structure by lattice braces 46. Braces 46 include upwardly and inwardly angled braces 46A, 46B emanating from cross braces 44 towards shaft 39, and substantially parallel with horizontal stringers 46E. Strike-off 41 initially engages the concrete 25 for initial leveling or "striking-off."

Vibration is concurrently provided by an eccentrically weighted shaft 45. A pillow block 43 mounted on the frame cross piece 44 mounts the drive shaft 45. The drive shaft has weighted eccentrics 47 on either side of the pillow blocks 43. Shaft 45 is forcibly driven by a conventional motor (not shown) mounted on the triangular truss screed. Vibration compacts the plastic concrete 25 which is concurrently finished by mechanical contact with the strike-off 41 and the smoothing action of trailing float 42. Alternatively, multiple spaced apart pneumatic or electric vibrators can be employed.

The chosen concrete finishing tool is supported at spaced apart intervals by the tower assemblies 60. Each tower assembly 60 generally comprises a front facing the direction of travel and a rear mated to the finishing mechanism. hinged ski 62 supported by a forward stanchion 64 and a rear stanchion 66 that extend upwardly from the ski 62. An upper strut 48 extends between the stanchions 64 and 66 forming the top of each tower 60. The ski 62 rides on the sub-grade 22 or rebar 23 below the surface of the concrete 25. Each ski 62 comprises a forward end 63 terminating in a point 68 that faces the direction of travel. A hinge 62A is disposed at the center of the ski 62 to flexibly couple the leading end 63 to trailing ski end 63A.

The lower portions 64A, 66A of the stanchions are constructed of square steel tubing. Upper extensible cylinders 64B, 66B, preferably hydraulic, have rods 64C, 66C linked to knife shaped supports 64D, 66D pivoted to the skiis. The top strut 48 is pinned to the upper extreme of the cylinders. A bridge assembly 80 extends from one stanchion 64, 66 to the other, above similar cross braces 83. Vertical columns 75, 76 extend from the bridge 80 to the strut 48. As the cylinders contract or extend, the bridge 80 and struts 83 are lifted or lowered, controlling the finishing elevation of the screed or finishing tool, carried behind the towers.

A control panel 120 on each tower senses information from two laser sensors 121 and 122 that communicate with the remote beacon. The electromechanical and hydraulic controls for the present device take a variety of forms consistent with those outlined in my previously referenced patents. Control information ultimately extends or retracts the stanchions 64 or 66 by controlling electric-hydraulic control valves 125. The cylinder controls are interconnected to the speed control valves 150 for the winch 160. Motor 130 mounted on bridge 80 drives hydraulic pump whose output is switched to the various cylinders via valve 125. Needle valves 127 can be adjusted to fine tune flow control to prevent rocking or oscillation of the screed finishing member.

The winch 160 is preferably mounted to the forward bridge sleeve 64F. The winch 160 spools a cable 161 that is passed through controlled 167 and secured to a fixed remote point. The winch 160 moves the device 20 along the plastic concrete 25 to be surfaced or treated.

With primary referenced now directed to FIGS. 3 through 9, the preferred quick-connect mounting system has been generally designated by the reference numeral 200. As discussed earlier, the triangular truss screed may be replaced with other vibrational tool. Screed 30 includes a lower L-shaped strike off 41 and a trailing float 42 of similar L-shaped cross section. Strikeout 41 has a flat, upwardly angled, flange portion 201 similar to portion 202 of float 42.

Figure 7:
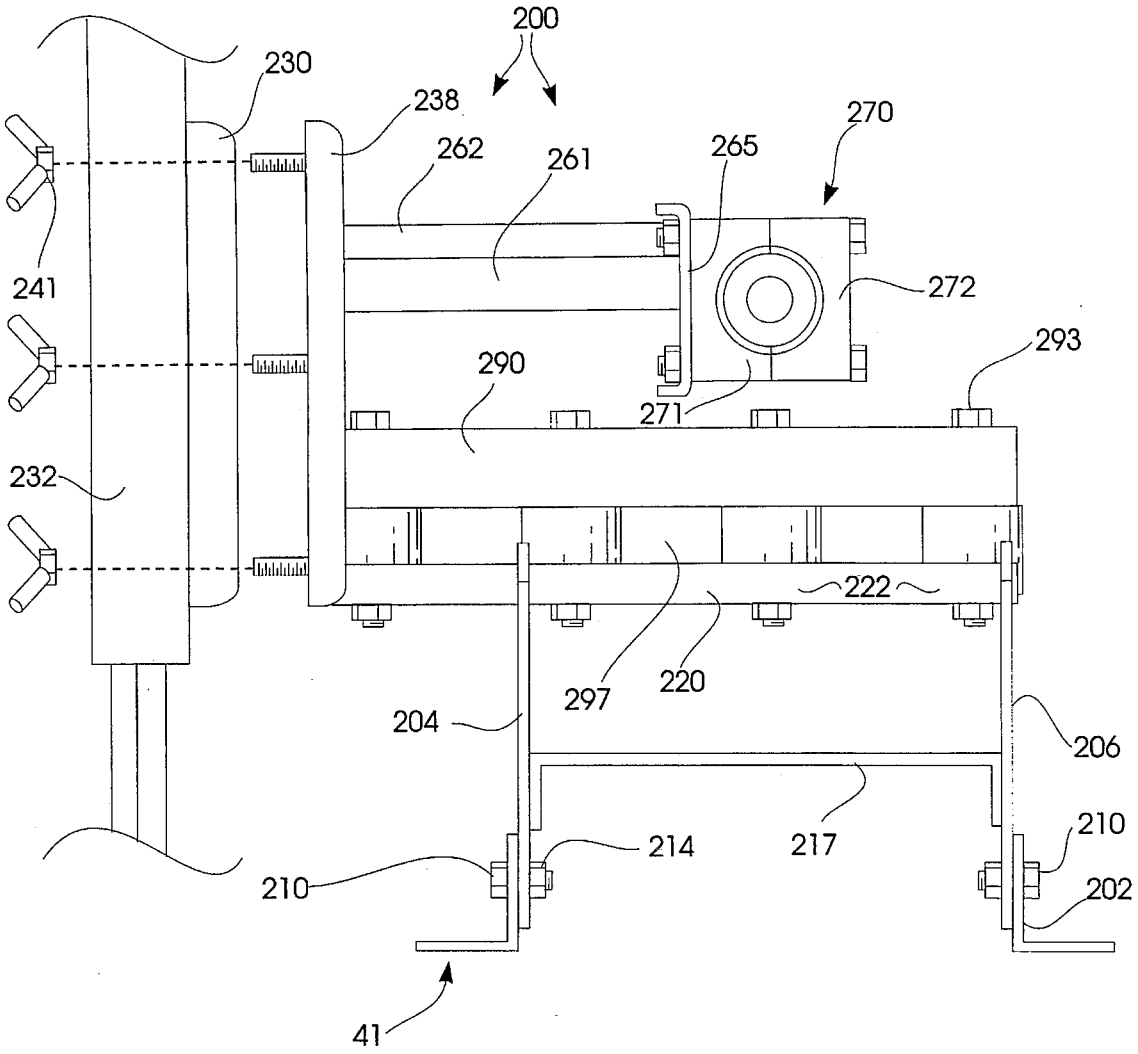
FIG. 7. is an enlarged, partially exploded side elevational view of the preferred mounting system, with portions omitted for clarity; and, FIGS. 8 and 9 are fragmentary side elevational views of the preferred mounting system showing alternative positions.
Figure 8:
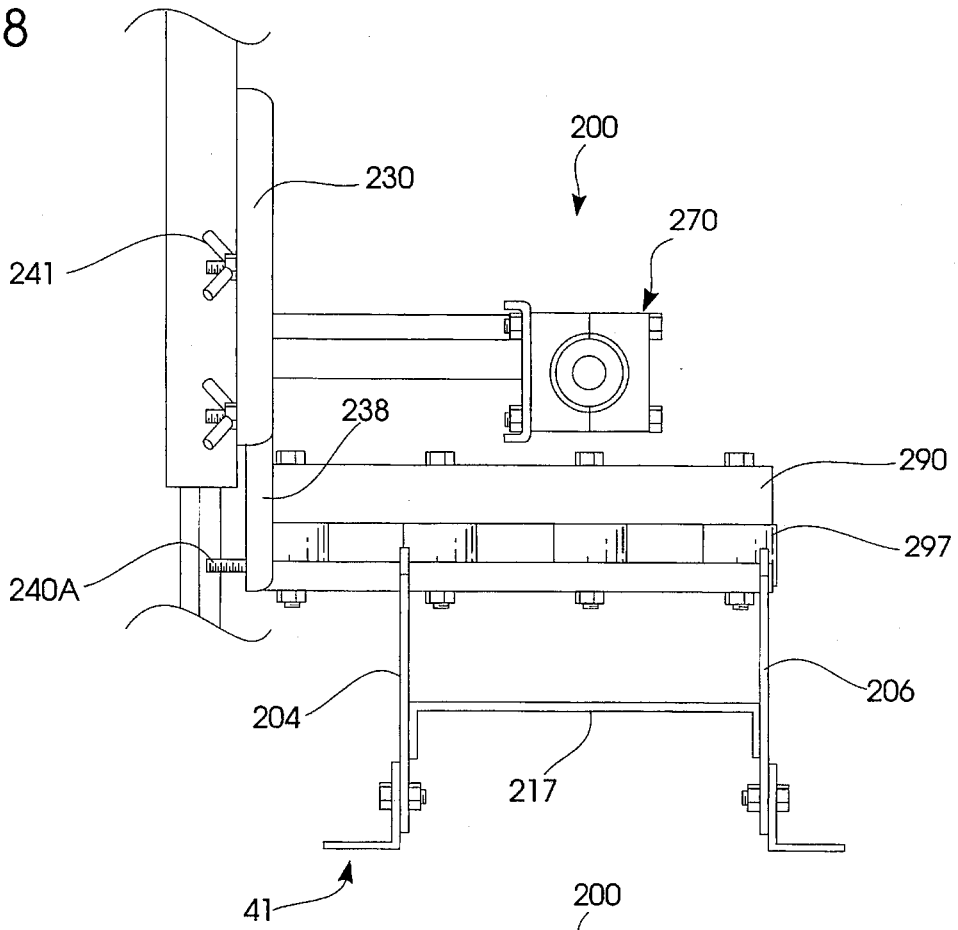
Figure 9:
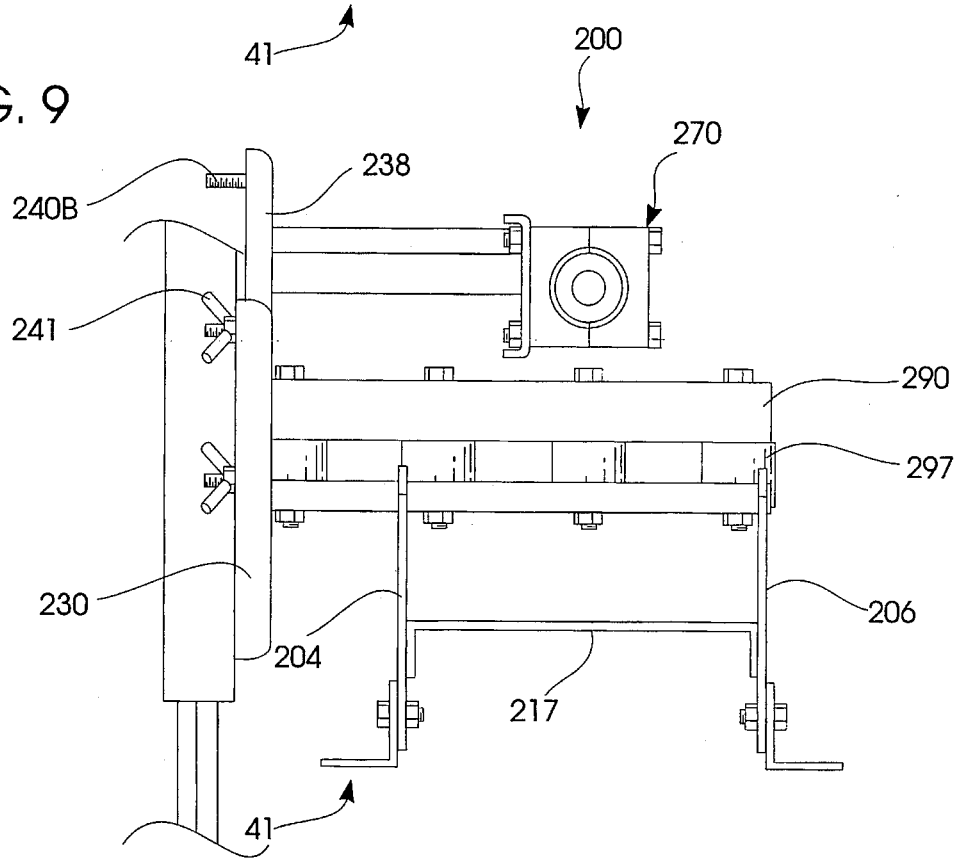

The mounting system 200 is connected to the finishing mechanism 30 at a number of points. Dampening has been achieved in more than one plane to resist translated vibrational forces in a variety of vector directions. A pair of plates 204, 206 are disposed on opposite sides of the base region of the finishing mechanism, as low to the ground as possible. Numerous bolts 210 are secured through suitable mounting orifices 212 (FIG. 5) and tightened with conventional bolts 214. As best seen in FIGS. 7 through 9, a transverse reinforcement plate 217 extends between plates 204 and 206 above the finishing mechanism for structural rigidity. An upper transverse bracket 220 extends generally horizontally between suitable notches defined in the tops of plates 204, 206. For rigidity, bracket 220 includes integral flanges 222 on each of its exposed sides.

Figure 3:
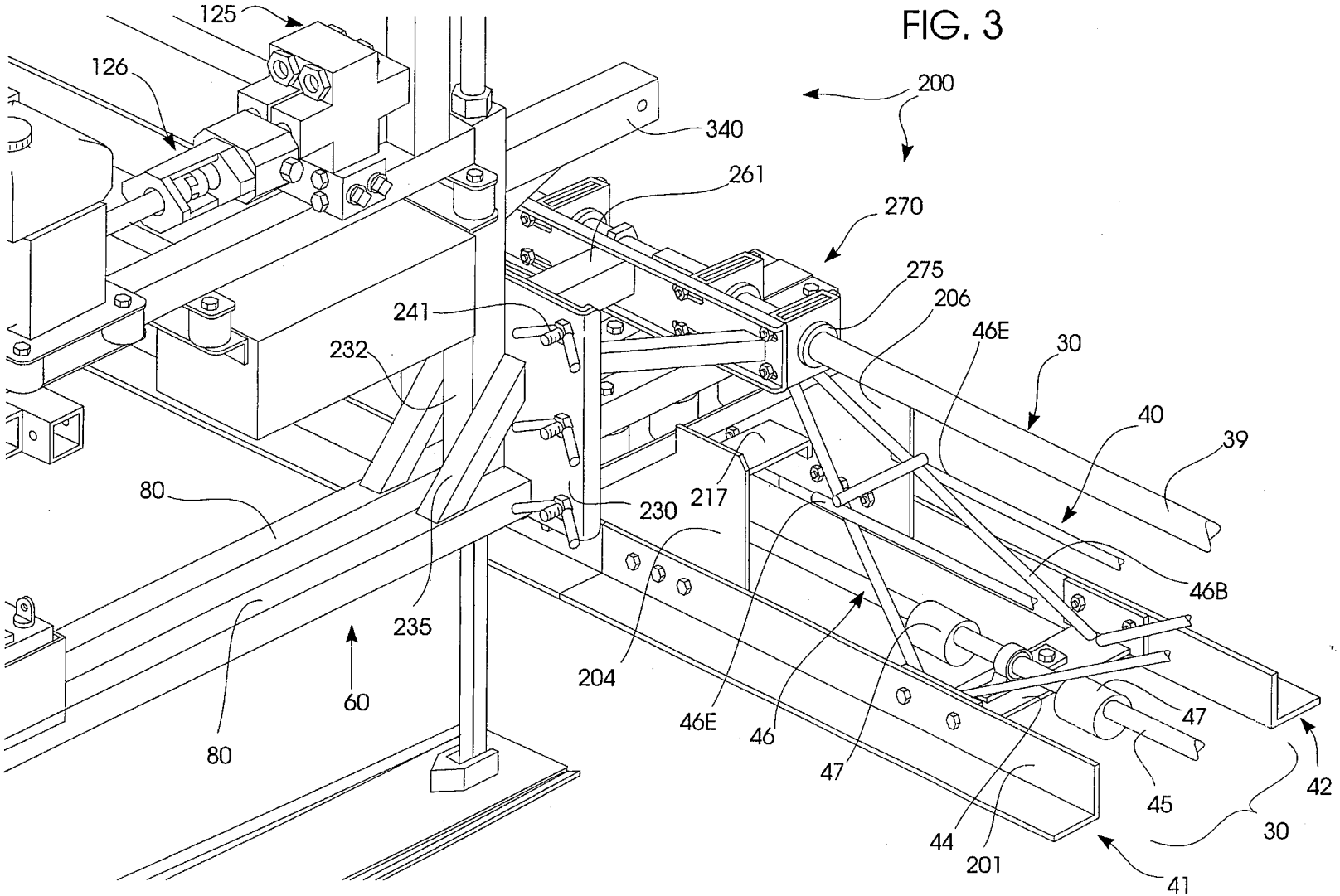
FIG 3.is a enlarged fragmentary, isometric view of the circled area.
Figure 4:
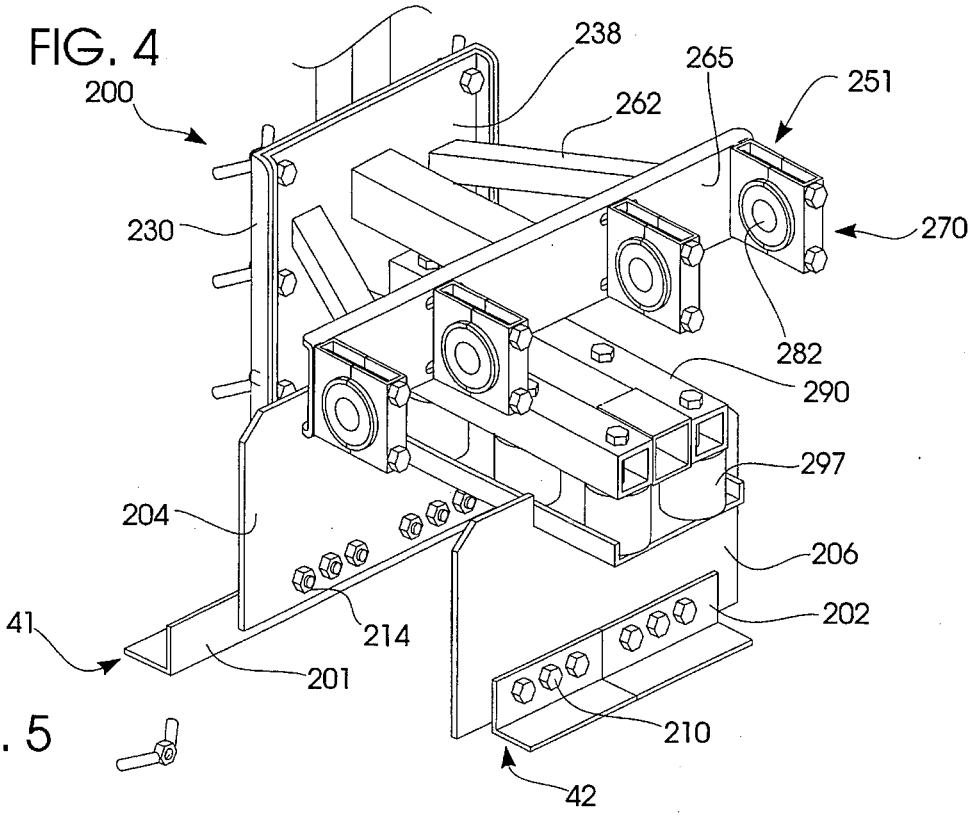
FIG 4. is an enlarged and fragmentary, rear isometric view Of the preferred mounting system.
Figure 5:
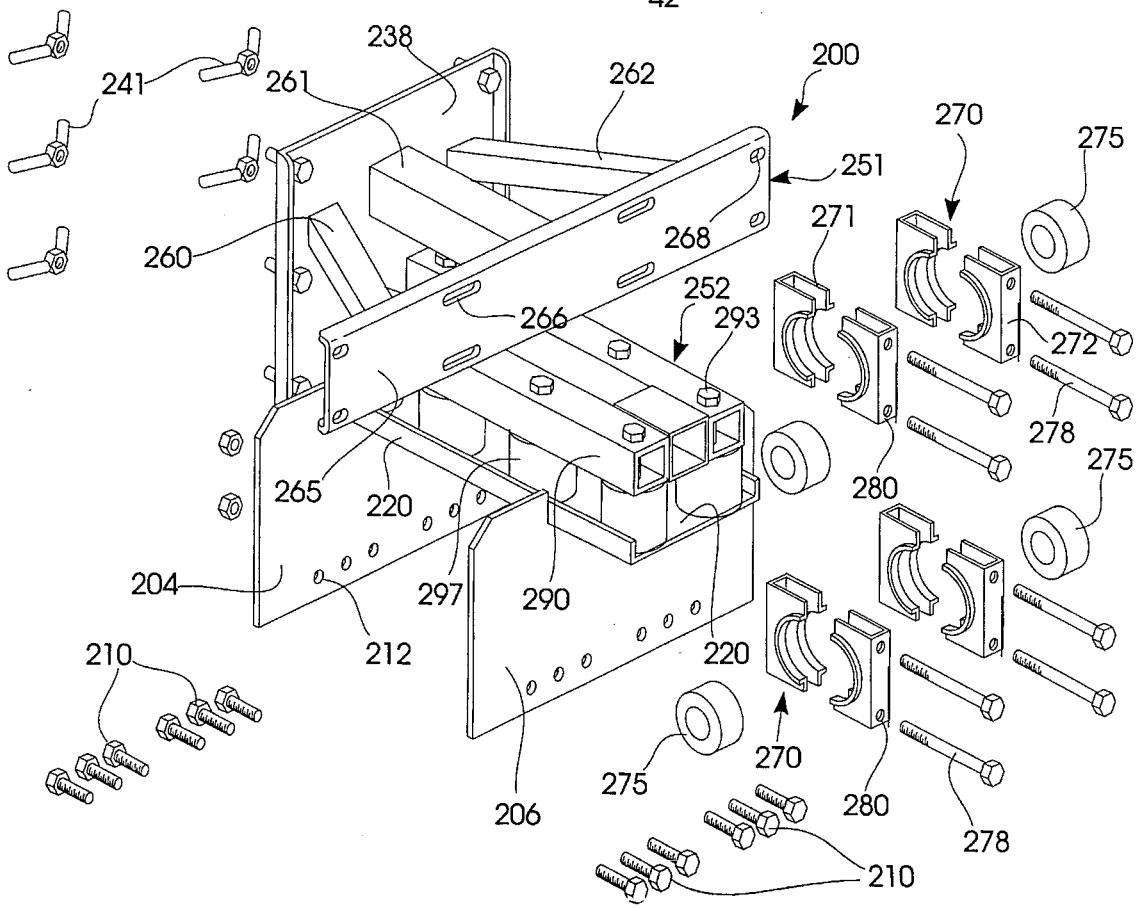
FIG 5. is a enlarged, partially exploded isometric view of the preferred mounting system.

As viewed in FIG. 3, a rigid plate 230 is generally vertically mounted to the sleeve portion 232 of the tower rear side. Fixed plate 230 is welded to sleeve 232, and reinforced by struts 235 angling towards bridge 80. A similarly configured companion plate 238 on the mounting system is adapted to be mated to plate 230 to secure apparatus directly to the tower system. Conventional bolts 240 extend generally transversely from plate 238 towards and through plate 230 for removable affixation with suitable wing nuts 241. These wing nuts 241 may easily be changed on the job site to quick connect or disconnect the finishing mechanism from the towers.

Plate 238 supports an upper brace structures 251 and a lower brace structure 252, both of which project horizontally rearwardly away from the towers. The upper brace structure is adapted to be coupled to the triangular truss shaft 39, as seen in FIG. 3. The lower brace structure couples the tower to the lower screed section, as will hereinafter be described.

Upper brace section 251 comprises struts 260, 261 and 262 welded to plate 238 and projecting generally rearwardly 28 therefrom. These struts support a generally longitudinally oriented, elevated mounting plate 265 provided with suitable mounting slots 266 and mounting orifices 268. The triangular truss shaft 39 is captivated within suitable isolating mounting bracket 270, each of which includes a generally semi-circular portion 271, which is mated to a similar portion 272 with a suitable resilient doughnut-shaped dampener 275 captivated therebetween. The rotary bracket assemblies 270 are fastened with suitable bolts 278 that penetrate mounting orifices 280, and they are secured in the slots 266 or bracket orifices 268 with nuts 281. The brackets 270 are disclosed in assembled form in FIG. 4, and the resulting aligned orifices 282 presented by the sandwiched doughnuts 275 captivate the truss rod 39. The resilient doughnuts dampen vibrations from the truss rod 39. Thus, the truss rod 39 is vibrationally isolated, and yet generally horizontally aligned, extending between and through the plurality of aligned doughnuts 275, generally secured to bracket system 251.

Figure 6:
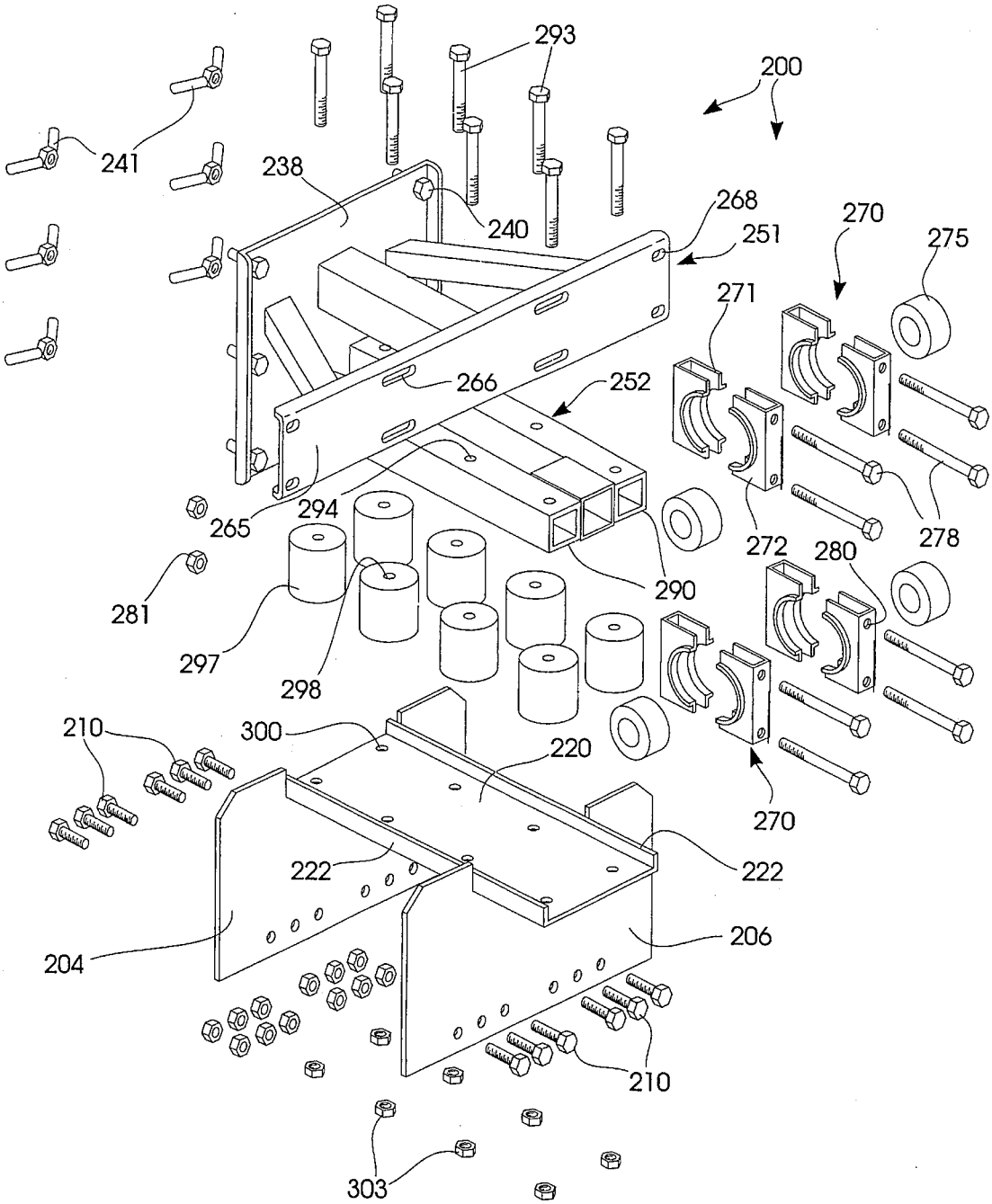
FIG. 6.is an enlarged, exploded isometric view of the preferred mounting system.

Bracket system 252 beneath bracket 251 comprises a pair of outwardly projecting spaced apart, square tubes 290. These tubes are placed generally vertically above and parallel to lower bracket 220. Numerous bolts 293 extend downwardly through suitable orifices 294 in tubes 290 and penetrate cylindrical dampers 297, passing through orifices 298 therein. The bolts 293 also penetrate orifices 300, and are secured underneath bracket 220 by suitable nuts 303 (FIG. 6). Thus, the multiple cylindrical dampeners 297 disposed between lower mounting bracket 252 and bracket 220 provide vibrational dampening between the 1load borne by plates 204 and 206, which are attached at opposite, bottom sides of the finishing tools as previously described. Their longitudinal axis is oriented ninety degrees from the axis of the isolating doughnuts 275 previously described.

As best seen in FIG. 8, the mounting system 200 can be lowered with respect to the supporting stanchions by varying the relative vertical position of plate 238. In other words, a comparison of FIG. 3, wherein all three wing nuts 241 have been employed with FIG. 8 and 9, reveals that the system can be mounted with but two wing nuts or bolts 240. In FIG. 8, the plate 238 has been shifted downwardly (i.e., as viewed in FIG. 8) towards a cement surface, so that only two of the wing nuts 241 register properly and thus, bolt **240*a*** is floating. In this manner, the finishing tool has been moved downwardly, and thus, is amenable to sub-grading operations and the like.

On the other hand, in FIG. 9 it is apparent that plate 238 has been shifted upwardly with respect to the control tower in plate 230 as its upper bolt **240*b*** is now floating and disposed above the apparatus. In this fashion, the finishing tool is moved upwardly for deeper pours.

Figure 2:
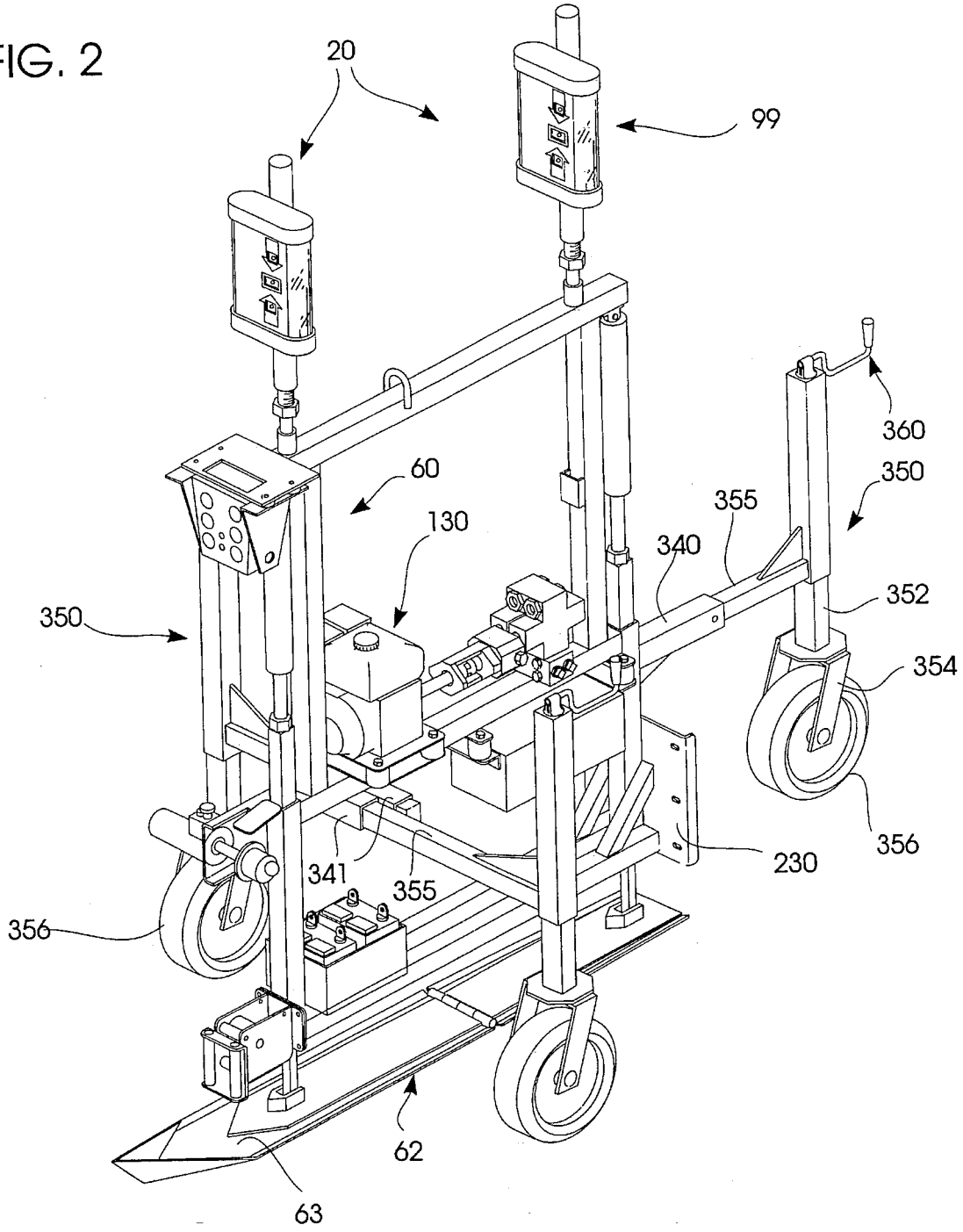
FIG 2. is a fragmentary perspective view of the best mode of the preferred ski transport system,showing how it is maneuvered at a job site with dolly wheels.

From the rear of the tower assemblies a square tube 340 projects. Another pair of square tubes 341 (FIG. 1 and 2) are mounted transversely beneath the bridge 80. Dolly wheel assemblies 350 have upright stanchions 352 secured to forks 354 that secure to suitable transportation wheels 356. A strut 355 penetrates the dolly wheel support tubes 341, and elevation may be adjusted by turning handle 360 to adjust the apparatus for transportation.

OPERATION

The skis 62 will support the screed 30 to ride over subgrade 22 or rebar 23. The skis 62 provide stability as well as support. Pans can be employed on the ends of the screed to provide finished edges. Skis 62 are used when the concrete being finished will have a wet joint interface with other concrete or it interfaces with a wall surface or against an isolation joint or key lock form. The stanchions 64, 66 run through the concrete being finished. A finishing pass by a bullfloat will cover any trace of grout seams left by the passing ski 62 and stanchions 64, 66. Other paving jobs may require outboard wheels attached to the tower mounts 180, 182.

The screed 30 should first be assembled on a flat surface. Straightness should be checked with the screed 30 resting in its operating position on the subgrade 22. A stringline or wire line may be used to carefully check straightness, joint closure and twist of the screed 30. Any irregularities remaining in the screed blade profile will transfer to the finished concrete.

A number of the above described tower assemblies 60 are necessary to control a screed 30. Generally at least two units are utilized. With the screed 30 in place on the subgrade 22, the screed 30 is adjusted to the desired slab thickness. Next, the elevation of the screed 30 is fixed relative to the sensors 99. Sensors 99 are vertically positioned by threaded sleeves 95 (FIG. 1) threadably coupled to shaft 96 and locked with jam nut 97.

The length of the towers is adjusted to ensure that the hydraulic cylinders have sufficient travel in both directions. Hence, once set up, the hydraulic piston rod should be at one half stroke. Therefore, adequate stroke will be available during automatic grade control finishing to accommodate screed travel while the skis 62 are extended and/or retracted while negotiating the uneven subgrade. If height adjustments are required, the end of the screed 30 can be lifted with a hydraulic floor jack, and the wing nuts 241 can be removed for adjustments. Alternatively, screw jacks may be fitted to the towers 60 to facilitate height adjustments.

The device 20 is controlled by a laser beacon of a conventional design such as Models LB-1 or LB-4 offered by Laser Alignment Inc. The beacon is deployed using a benchmark reference to establish a fixed elevation. Furthermore, the beacon can be established at an angle to facilitate finishing concrete 25 at a predetermined crossfall grade. The laser beacon creates a plane of laser light at a fixed elevation and angle which the sensors 99 of the device 20 will detect.

Thereafter, it is necessary to conventionally adjust the sensor 99 upon the mast 94 to obtain initial alignment. The sensor 99 must be situated so that it is in line of sight with the beacon throughout the pour. Sensor 99 height and position are easily positioned on the mast 94 and fixed in place utilizing the adjustments to jam nut 97.

Functionality of the device is checked by levering or tilting a ski 62. The screed 30 should remain at finish grade level. The desired travel speed is set at the hydraulic winches 160, and a trial run of several feet is commenced to insure that everything is functioning properly. As the device 20 is towed with its attached tool over the surface of the concrete 25 by the winch 160, the sensors 99 receive the light beam and adjust the system to maintain the sensor relative to the light beam. The control panel 120 receives the sensor output and provides the necessary instructions to control the elevation of the tool via the hydraulic cylinder controls and thereby the extensible stanchions 64, 66.

With the screed 30 at its starting position, the first batch of concrete is placed, and screed vibration is commenced. The degree of vibration will depend upon concrete slump and admix properties. With plastic concrete in place across the forward blade 31, the travel speed of each winch 160 is adjusted to maintain the screed 30 perpendicular to the direction of travel. Low slump and dry mix ratios will affect screed vibration amplitude and travel speed. As the screed 30 progresses, grade, flatness and levelness should periodically be rechecked.

To provide a good finish, the strike-off blade should be fed one and a half to two and a half inches of surcharge. This surcharge results in a dense, uniform struck-off concrete mass. Of course, since it is positioned behind the rear knife portion 66D (FIG. 1) of the stanchion (which is traveling through the plastic concrete) it will smooth the furrow left in its wake.

Finish grades which incorporate crossfall must be monitored. Screed vibration tends to cause the slab monolith to settle and slump downwardly. If a crossfall is required, then the high side may require some hand work to maintain the desired grade and the low side may need to be restruck by hand.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An offset laser-operated, automatic grade control screed for treating plastic concrete, said screed having a direction of screed travel and comprising:

an elongated concrete finishing mechanism adapted to be deployed in physical contact with said concrete, said finishing mechanism comprising strike-off means for cutting, striking off and leveling rough, freshly poured concrete and vibrator means for vibrating said finishing mechanism and said concrete to smooth and settle the concrete;

vertical tower means for controlling the finishing mechanism, said tower means adapted to vary in height to control an orientation and elevation of the finishing mechanism, and said tower means comprising a front facing the direction of screed travel and a rear;

stanchion means for extending or and contracting said tower means;

control means for controlling the extending and contracting of said tower means in response to laser means;

ski means for being disposed upon a floor or upon a subgrade for supporting the tower means and enabling the screed to be drawn through freshly poured concrete in the direction of screed travel; and, means for dynamically mounting said finishing mechanism to said tower means rear wherein furrows caused by movement of the rear of the tower means through the concrete are finished.

2. The screed as defined in claim 1 wherein said means for dynamically mounting said finishing mechanism to said tower means further comprises:

a fixed plate affixed to the tower means;

a companion plate adapted to be secured to the fixed plate;

a generally horizontal mounting bracket secured to the finishing mechanism; and, dampened means for coupling said companion plate to said generally horizontal mounting bracket.

3. The screed as defined in claim 1 wherein said finishing mechanism has an elongated rod portion and wherein said means for dynamically mounting said finishing mechanism to said tower means further comprises:

a fixed plate affixed to the tower means;

a companion plate adapted to be secured to the fixed plate and having a rear;

a generally transverse mounting bracket secured at the rear of the companion plate generally parallel therewith; and dampened means for coupling said generally transverse mounting bracket to said elongated rod portion of the finishing mechanism.

4. The screed as defined in claim 3 wherein said means for dynamically mounting said finishing mechanism to said tower means further comprises:

a generally horizontal mounting bracket secured to the finishing mechanism below said generally transverse mounting bracket; and, dampened means for coupling said companion plate to said generally horizontal mounting bracket.

5. The screed as defined in claim 4 wherein said dampened means for coupling said companion plate to said generally horizontal mounting bracket comprises a longitudinal axis oriented ninety degrees from a longitudinal axis of said dampened means for coupling said generally transverse mounting bracket to said elongated rod portion of the finishing mechanism whereby dampening has been achieved in more than one plane to resist translated vibrational force in a variety of vector directions.

6. A laser-operated, automatic grade control screed for treating plastic concrete said screed having a direction of screed travel and comprising:

an elongated triangular truss finishing mechanism adapted to be deployed in physical contact with said concrete, said finishing mechanism comprising strike-off means for cutting, striking off and leveling rough, freshly-poured concrete, float means trailing the strike off means, said strike-off means and said float forming a base of said finishing mechanism, an upper truss rod forming a vertex of the finishing mechanism, and vibrator means for vibrating said finishing mechanism and said concrete to smooth and settle the concrete;

vertical tower means for controlling the finishing mechanism, said tower means adapted to vary in height to control an orientation and elevation of the finishing mechanism, and said tower means comprising a front facing the direction of screed travel and a rear facing the triangular truss finishing mechanism;

cylinder means for extending and contracting said tower means;

control means for controlling the extending and retracting of said tower means in response to laser means;

ski means for being disposed upon a floor or upon a subgrade and for supporting the tower means and enabling the screed to be drawn through freshly poured concrete in the direction of travel; and, means for dynamically mounting said finishing mechanism to said tower means rear wherein furrows caused by movement of the rear of the tower means through the concrete are finished.

7. The screed as defined in claim 6 wherein said means for dynamically mounting said finishing mechanism to said tower means further comprises:

a fixed plate affixed to the tower means;

a companion plate adapted to be secured to the fixed plate;

a generally horizontal mounting bracket secured to the base of the finishing mechanism; and, dampened means for coupling said companion plate to said generally horizontal mounting bracket.

8. The screed as defined in claim 6 wherein said means for dynamically mounting said finishing mechanism to said tower means further comprises:

a fixed plate affixed to the tower means;

a companion plate adapted to be secured to the fixed plate and having a rear;

a generally transverse mounting bracket secured at the rear of the companion plate generally parallel therewith; and, dampened means for coupling said generally transverse mounting bracket to said upper truss rod.

9. The screed as defined in claim 8 wherein said means for dynamically mounting said finishing mechanism to said tower means further comprises:

a generally horizontal mounting bracket secured to the base of the finishing mechanism below said transverse mounting bracket; and, dampened means for coupling said companion plate to said generally horizontal mounting bracket.

10. The screed as defined in claim 9 wherein said dampened means for coupling said companion plate to said generally horizontal mounting bracket comprises a longitudinal axis oriented ninety degrees from a longitudinal axis of said dampened means for coupling said generally transverse mounting bracket to said upper truss rod, whereby dampening has been achieved in more than one plane to resist translated vibrational forces in a variety of vector directions.

* * * * *